US010818219B2

(12) United States Patent
Kim et al.

(10) Patent No.: US 10,818,219 B2
(45) Date of Patent: Oct. 27, 2020

(54) DISPLAY APPARATUS AND METHOD OF DRIVING DISPLAY PANEL USING THE SAME

(71) Applicant: SAMSUNG DISPLAY CO, LTD., Yongin-si, Gyeonggi-Do (KR)

(72) Inventors: Yu-Chol Kim, Pyeongtaek-si (KR); Keunoh Kang, Uijeongbu-si (KR); Sujin Lee, Hanam-si (KR); Min-Soo Choi, Hwaseong-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/052,059

(22) Filed: Aug. 1, 2018

(65) Prior Publication Data

US 2019/0213942 A1 Jul. 11, 2019

(30) Foreign Application Priority Data

Jan. 9, 2018 (KR) ..... 10-2018-0002963

(51) Int. Cl.
*G09G 3/20* (2006.01)

(52) U.S. Cl.
CPC ... *G09G 3/2092* (2013.01); *G09G 2300/0413* (2013.01); *G09G 2310/027* (2013.01); *G09G 2310/0291* (2013.01); *G09G 2310/061* (2013.01); *G09G 2310/08* (2013.01); *G09G 2330/021* (2013.01); *G09G 2370/08* (2013.01)

(58) Field of Classification Search
CPC ..... G09G 3/2092; G09G 2300/0413; G09G 2310/027; G09G 2310/0291; G09G 2310/061; G09G 2310/08; G09G 2330/021; G09G 2370/08
See application file for complete search history.

(56) References Cited

U.S. PATENT DOCUMENTS

2015/0187273 A1* 7/2015 Chang ..... G09G 3/3233 345/690
2016/0019824 A1* 1/2016 Choi ..... G09G 3/3666 345/694
2016/0118010 A1* 4/2016 Hsu ..... G09G 5/005 345/213
2016/0379588 A1* 12/2016 Kim ..... G09G 3/3696 345/214

FOREIGN PATENT DOCUMENTS

KR 10-2007-0109109 11/2007
KR 10-2011-0027538 3/2011
KR 10-2014-0112819 9/2014
KR 10-2016-0017871 2/2016

* cited by examiner

*Primary Examiner* — Nelson M Rosario
(74) *Attorney, Agent, or Firm* — F. Chau & Associates, LLC

(57) ABSTRACT

A display apparatus includes a display panel, a gate driver and a data driver. The display panel displays an image. The gate driver outputs gate signals to the display panel. The data driver outputs data voltages to the display panel. The data driver includes a plurality of data driving circuits. At least two data driving circuits among the data driving circuits have different turn off timings or different turn on timings in a vertical blank period.

25 Claims, 10 Drawing Sheets

DISPLAY APPARATUS AND METHOD OF DRIVING DISPLAY PANEL USING THE SAME

CROSS-REFERENCE TO RELATED APPLICATIONS

This application claims priority under 35 U.S.C. § 119 to Korean Patent Application No. 10-2018-0002963, filed on Jan. 9, 2018 in the Korean Intellectual Property Office KIPO, the contents of which are herein incorporated by reference in their entireties.

BACKGROUND

1. Technical Field

Exemplary embodiments of the present inventive concept relate to a display apparatus and a method of driving a display panel using the display apparatus.

2. Discussion of Related Art

A display apparatus includes a display panel and a display panel driver to drive the display panel. The display panel includes a plurality of gate lines, a plurality of data lines and a plurality of pixels. The display panel driver includes a gate driver and a data driver. The gate driver outputs gate signals to the gate lines. The data driver outputs data voltages to the data lines.

A frame period when the display panel displays an image may include an active period and a vertical blank period. During the active period, the gate lines in an active area of the display panel are scanned and the data voltages are outputted to the pixels in the active area of the display panel.

However, peak currents may be generated every frame period so that driving noise of the display apparatus is generated, display quality of the display panel deteriorates and power consumption of the display apparatus increases.

SUMMARY

At least one exemplary embodiment of the present inventive concept provides a display apparatus turning on and off driving blocks at different timings in a vertical blank period to reduce noise, to enhance display quality of a display panel and to reduce power consumption of the display apparatus.

At least one exemplary embodiment of the present inventive concept also provides a method of driving a display panel using the above-mentioned display apparatus.

In an exemplary embodiment of a display apparatus according to the present inventive concept, the display apparatus includes a display panel, a gate driver and a data driver. The display panel displays an image. The gate driver outputs gate signals to the display panel. The data driver outputs data voltages to the display panel. The data driver includes a plurality of data driving circuits. At least two data driving circuits among the data driving circuits have different turn off timings or different turn on timings in a vertical blank period.

In an exemplary embodiment, the data driving circuits are sequentially turned off in the vertical blank period.

In an exemplary embodiment, the data driving circuits are sequentially turned on in the vertical blank period.

In an exemplary embodiment, the data driving circuits have turn off periods having substantially the same length.

In an exemplary embodiment, at least one data driving circuit among the data driving circuits include a digital to analog converter which receives data signals having a digital type and converts the data signals into the data voltages having an analog type, a plurality of output buffers which output the data voltages to the data lines and a plurality of output buffer switches which are disposed between the data lines and the output buffers, and enable or disable connections between the data lines and the output buffers.

In an exemplary embodiment, the display apparatus further includes a driving controller that controls an operation of the gate driver and an operation of the data driver. The data driving circuits may include a first data driving circuit and a second data driving circuit. The driving controller may output a first switching signal for controlling an operation of output buffer switches of the first data driving circuit to the first data driving circuit and a second switching signal for controlling an operation of output buffer switches of the second data driving circuit to the second data driving circuit.

In an exemplary embodiment, the display apparatus further includes a driving controller that controls an operation of the gate driver and an operation of the data driver. The data driver may include a first data driving circuit and a second data driving circuit. The driving controller may output a first switching signal for controlling an operation of output buffer switches of the first data driving circuit. The first driving circuit may output a second switching signal for controlling an operation of output buffer switches of the second data driving circuit to the second data driving circuit.

In an exemplary embodiment, the first driving circuit includes a switching controller which receives the first switching signal, controls the output buffer switches of the first data driving circuit, generates the second switching signal based on the first switching signal and outputs the second switching signal to the second data driving circuit.

In an exemplary embodiment, the data driving circuits are data integrated circuit chips.

In an exemplary embodiment, at least one data driving circuit among the data driving circuits have a first turn on period, a second turn on period and a turn off period between the first turn on period and the second turn on period in the vertical blank period.

In an exemplary embodiment, at least one data driving circuit among the data driving circuits output last data voltages of a first active period which is prior to the vertical blank period during the first turn on period.

In an exemplary embodiment, at least one data driving circuit among the data driving circuits output first data voltages of a second active period which is after the vertical blank period during the second turn on period.

In an exemplary embodiment, at least one data driving circuit among the data driving circuits output a first data voltage representing a first preset grayscale during the first turn on period and the first data voltage representing the first preset grayscale during the second turn on period.

In an exemplary embodiment of a method of driving a display panel according to the present inventive concept, the method includes outputting gate signals to the display panel and outputting data voltages to the display panel using a plurality of data driving circuits. At least two data driving circuits among the data driving circuits have different turn off timings or different turn on timings in a vertical blank period.

In an exemplary embodiment, the data driving circuits are sequentially turned off in the vertical blank period.

In an exemplary embodiment, the data driving circuits are sequentially turned on in the vertical blank period.

In an exemplary embodiment, the data driving circuits have turn off periods having substantially the same length.

In an exemplary embodiment, at least one data driving circuit among the data driving circuits have a first turn on period, a second turn on period and a turn off period between the first turn on period and the second turn on period in the vertical blank period.

In an exemplary embodiment, at least one data driving circuit among the data driving circuits output last data voltages of a first active period which is prior to the vertical blank period during the first turn on period.

In an exemplary embodiment, at least one data driving circuit among the data driving circuits output first data voltages of a second active period which is after the vertical blank period during the second turn on period.

According to an exemplary embodiment of the inventive concept, a display panel driving a display panel is provided. The display panel includes a display area including first and second display blocks and a dummy area. The display panel driver includes a first data driving circuit driving the first display block, a second data driving circuit driving the second display block, and a driving controller controlling the data driving circuits to output data voltages to the display blocks during an active period of a frame period, the first data driving circuit to output dummy data voltages to the dummy area during a first turn on period of a vertical blanking period of the frame period, the second data driving circuit to output dummy data voltages to the dummy area during a second turn on period of the vertical blanking period of the frame period. The first and second periods differ from one another.

In an embodiment, driving controller prevents the first data driving circuit from outputting a data voltage or a dummy data voltage during a first turn off period of the vertical blank period that starts after the first turn on period, and prevents the second data driving circuit from outputting a data voltage or a dummy data voltage during a second turn off period of the vertical blank period that starts after the second turn on period.

In an embodiment, the driving controller controls the first data driving circuit to output dummy data voltages to the dummy area during a third turn on period of the vertical blanking period after the first turn off period, the second data driving circuit to output dummy data voltages to the dummy area during a fourth turn on period of the vertical blanking period after the second turn off period.

In an embodiment, a duration of the first turn off period is the same as a duration of the second turn off period.

In an embodiment, the first turn on period and second turn on period begin when the active period ends, and end at different times within the vertical blank period.

In a display apparatus according to at least one embodiment of the inventive concept and a method of driving the display panel using the display apparatus, the data driving circuits are turned on and off at different timings in a vertical blank period so that a change of load may be minimized due to polarity inversion of the data voltage and a difference between the level of the data voltage and the level of a dummy data voltage.

Thus, the noise generated by the polarity inversion of the data voltage and the difference between the level of the data voltage and the level of the dummy data voltage may be reduced.

In addition, a display defect generated by the voltage ripple in the vertical blank period may be prevented so that the display quality of the display panel may be enhanced.

In addition, the change of the load generated by the polarity inversion of the data voltage and the difference between the level of the data voltage and the level of the dummy data voltage may be minimized so that the power consumption of the display apparatus may be reduced.

BRIEF DESCRIPTION OF THE DRAWINGS

The present inventive concept will become more apparent by describing in detailed exemplary embodiments thereof with reference to the accompanying drawings, in which.

DETAILED DESCRIPTION OF THE INVENTIVE CONCEPT

Hereinafter, the present inventive concept will be explained in detail with reference to the accompanying drawings.

Figure 1:
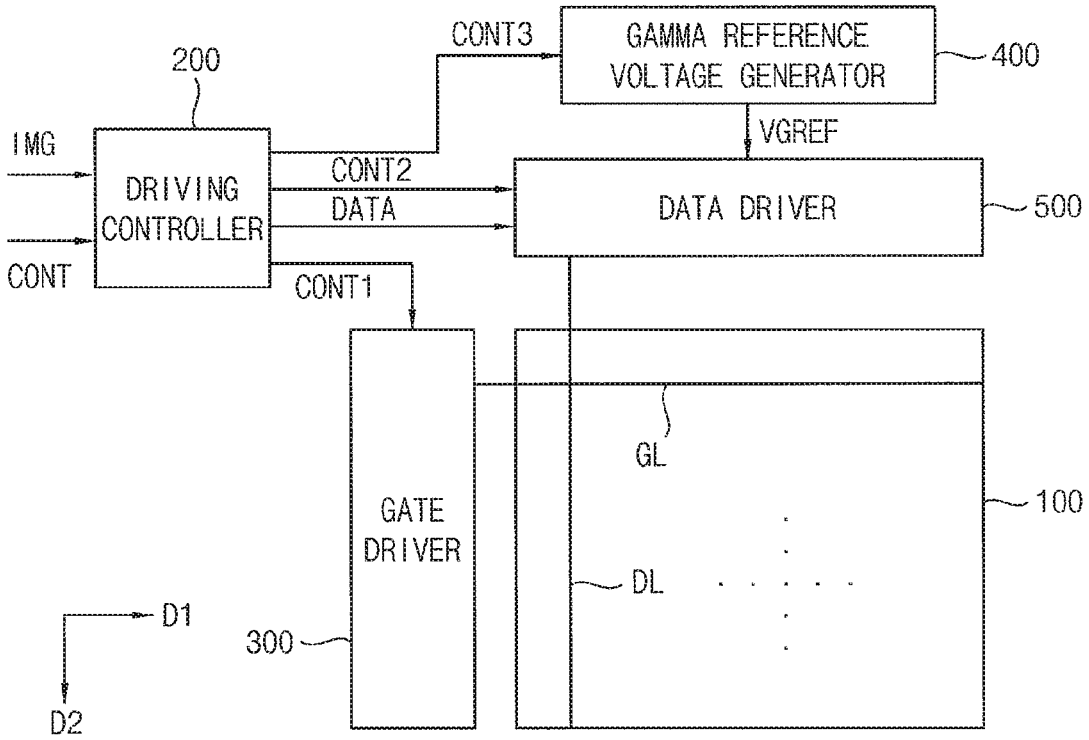
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, the display apparatus includes a display panel 100 and a display panel driver. The display panel driver includes a driving controller 200 (e.g., a control circuit), a gate driver 300 (e.g., a gate driving circuit), a gamma reference voltage generator 400 and a data driver 500 (e.g., a data driving circuit).

The display panel 100 includes a display region and a peripheral region adjacent to the display region. The peripheral region may surround the display region. The display panel 100 may be located in the display region while the controller (e.g., 200), drivers (e.g., 300 and 500), and the voltage generator (e.g., 400) are located in the peripheral region.

The display panel 100 includes a plurality of gate lines GL, a plurality of data lines DL and a plurality of pixels electrically connected to the gate lines GL and the data lines DL. The gate lines GL extend in a first direction D1 and the data lines DL extend in a second direction D2 crossing the first direction D1. In an embodiment, the first direction D1 is perpendicular to the second direction D2.

The driving controller 200 receives input image data IMG and an input control signal CONT from an external apparatus (not shown). The input image data IMG may include red image data, green image data and blue image data. The input image data IMG may include white image data. The input image data IMG may include magenta image data, yellow image data and cyan image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the driving controller 200. For example, the gate driver 300 may sequentially output the gate signals to the gate lines GL.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an exemplary embodiment, the gamma reference voltage generator 400 may be disposed in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

The data driver 500 includes a plurality of driving blocks (e.g., data driving circuits). At least two driving blocks among the driving blocks may have different turn off timings or different turn on timings in a vertical blank period.

Figure 2:
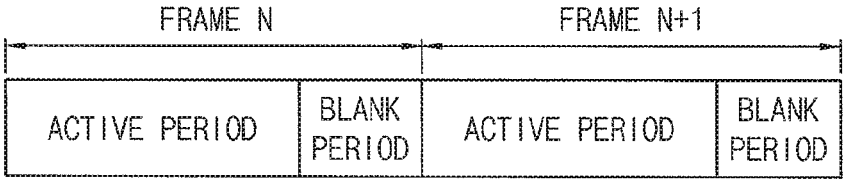
FIG. 2 is a timing diagram illustrating an active period when an image is displayed in an active area of a display panel of FIG. 1 and a blank period when the image is not displayed in the active area.
Figure 3A:
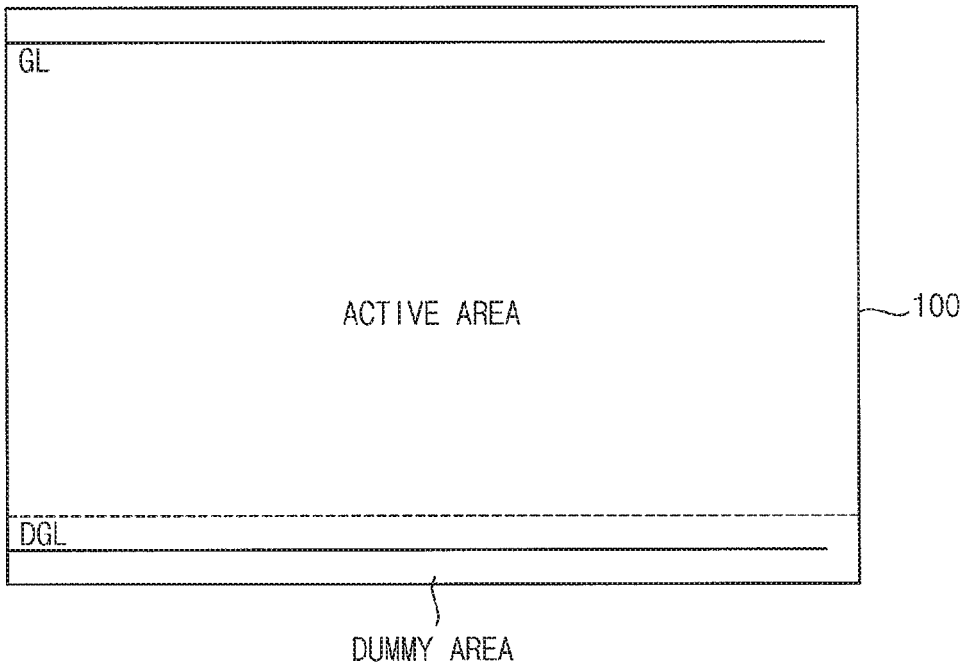
FIG. 3A is a conceptual diagram illustrating the active area and a dummy area of the display panel of FIG. 1 according to an exemplary embodiment of the inventive concept.
Figure 3B:
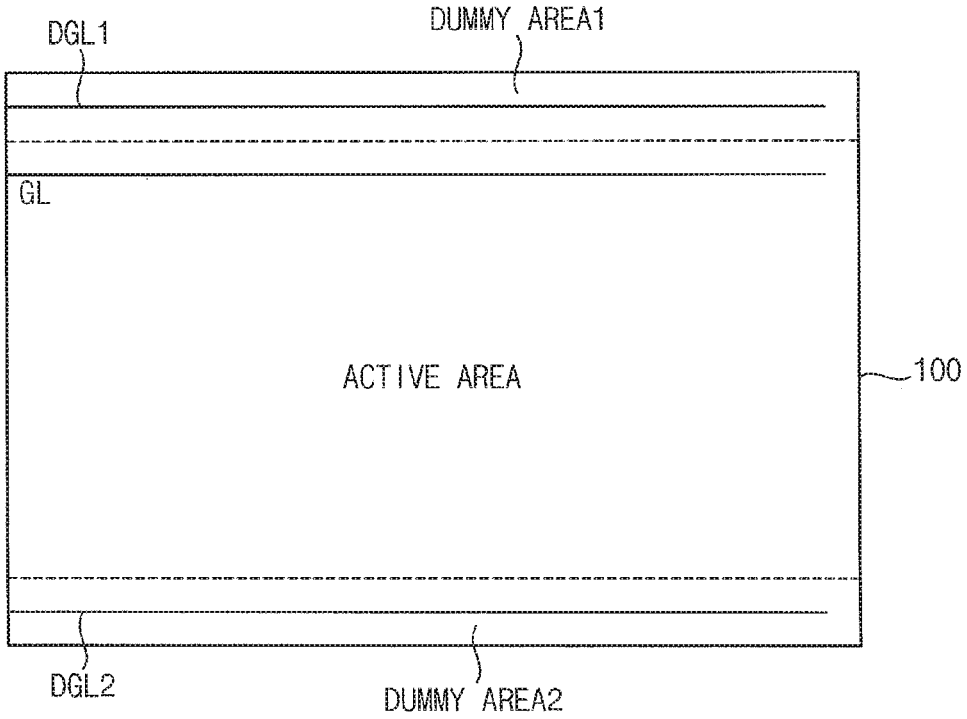
FIG. 3B is a conceptual diagram illustrating the active area and the dummy area of the display panel of FIG. 1 according to an exemplary embodiment of the inventive concept.

FIG. 2 is a timing diagram illustrating an active period when an image is displayed in an active area of the display panel 100 of FIG. 1 and a blank period when the image is not displayed in the active area. FIG. 3A is a conceptual diagram illustrating the active area and a dummy area of the display panel of FIG. 1 according to an exemplary embodiment of the inventive concept. FIG. 3B is a conceptual diagram illustrating the active area and the dummy area of the display panel of FIG. 1 according to an exemplary embodiment of the inventive concept.

Referring to FIGS. 1 to 3B, a driving period of the display panel 100 includes the active period (ACTIVE PERIOD in FIG. 2) when the image is displayed in the active area of the display panel 100 and the vertical blank period (BLANK PERIOD in FIG. 2) when the image is not displayed in the active area.

For example, during the active period, the gate signals are sequentially outputted to the gate lines GL in the active area of the display panel 100, the switching elements in the active area are turned on by the gate signals, the data voltages outputted from the data driver 500 are applied to the pixels and the image is displayed in the active area. The pixels are charged with the data voltages. The switching elements may control the pixels.

During the vertical blank period, dummy gate signals are sequentially outputted to dummy gate lines DGL in a dummy area of the display panel 100, dummy switching elements in the dummy area are turned on by the dummy gate signals and dummy data voltages are outputted from the data driver 500. The dummy area is a light blocking area so that the image by the dummy data voltages in the dummy area is not shown to a user. In an embodiment, the dummy area includes dummy pixels that may receive the dummy data voltages and are controlled by the dummy switching elements.

In FIG. 2, an N-th frame period includes the active period and the vertical blank period and an (N+1)-th frame period which is right after the N-th frame period includes the active period and the vertical blank period. Although, each frame period is illustrated as including an active period and a vertical blank period in FIG. 2, the term, the frame period, may be used to indicate the active period only. A frame of data may be output during the frame period. A frame of data may include enough data to supply all pixels of the display panel with data voltages.

In an exemplary embodiment of FIG. 3A, the dummy area corresponding to the vertical blank period is disposed at a lower side of the active area corresponding to the active period. The dummy gate lines DGL are disposed in the dummy area. For example, in FIG. 3A, the dummy area is disposed below and adjacent the active area.

In an exemplary embodiment of FIG. 3B, a first dummy area DUMMY AREA1 corresponding to a previous vertical blank period is disposed at an upper side of the active area corresponding to the active period and a second dummy area DUMMY AREA2 corresponding to a next vertical blank period is disposed at a lower side of the active area corresponding to the active period. For example, in FIG. 3B, the first dummy area DUMMY AREA1 is disposed above and adjacent the active area, and the second dummy area DUMMY AREA2 is disposed below and adjacent the active area. First dummy gate lines DGL1 are disposed in the first dummy area DUMMY AREA1 and second dummy gate lines DGL2 are disposed in the second dummy area DUMMY AREA2.

Figure 4A:
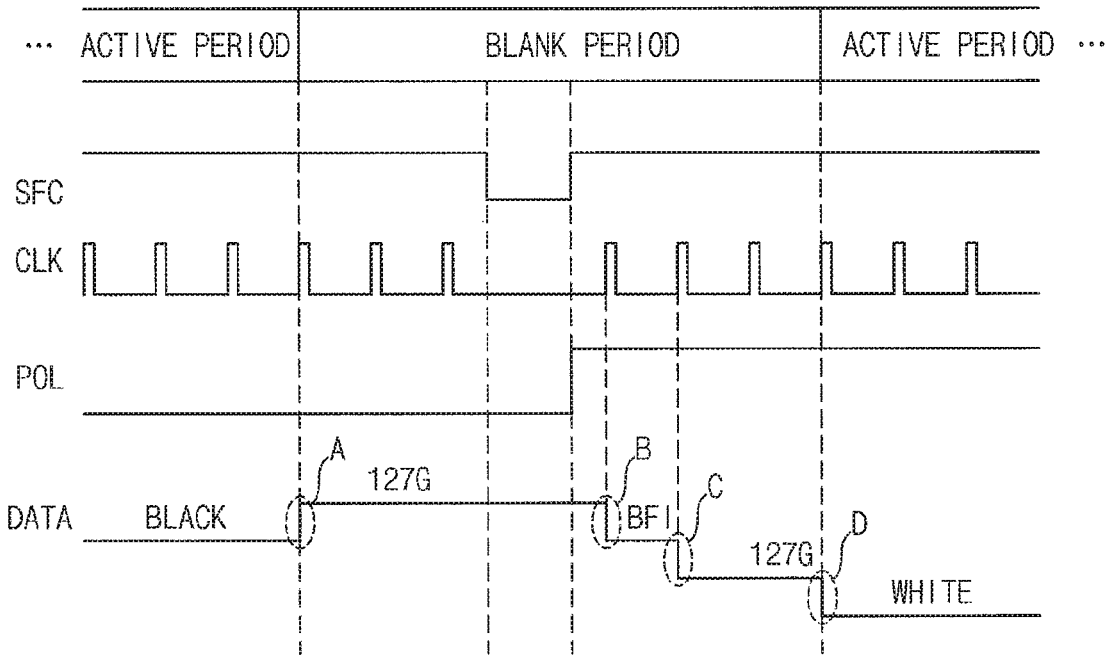
FIG. 4A is a timing diagram illustrating a change of load generated at a data driver of FIG. 1 by polarity inversion of a data voltage and a difference between a level of the data voltage and a level of a dummy data voltage according to an exemplary embodiment of the inventive concept.

FIG. 4A is a timing diagram illustrating a change of load generated at the data driver 500 of FIG. 1 by polarity inversion of a data voltage and a difference between a level of the data voltage and a level of a dummy data voltage according to an exemplary embodiment of the inventive concept.

Referring to FIGS. 1 to 4A, the vertical blank period is disposed between the active periods. In an exemplary embodiment, a polarity inversion of the data voltages and a refresh of the data voltages occur during the vertical blank period.

A boundary signal SFC represents the boundary between the active periods and divides a training period of a clock signal CLK and an active data period. The boundary signal SFC maintains a high level, decreases to a low level and then maintains the high level during the vertical blank period.

The clock signal CLK may be synchronized with the scanning timing of the gate signal in the gate driver 300. The clock signal CLK may be synchronized with a load signal for outputting the data voltage in the data driver 500. The load signal may indicate when to start the outputting of the data voltage.

An inversion control signal POL represents the polarity of the data voltage. In FIG. 4A, when the inversion control signal POL has a high level, the data voltages have a negative polarity. In contrast, when the inversion control signal POL has a low level, the data voltages have a positive polarity.

As shown in FIG. 4A, the inversion control signal POL is changed from the low level to the high level during the vertical blank period. Although not shown in figures, the inversion control signal POL may be changed from the high level to the low level during a next vertical blank period. For example, the level of the inversion control signal POL may be changed at a rising edge of the boundary signal SFC. For example, the inversion control signal POL may be changed from the high level to the low level during the next vertical blank period at the rising edge of the boundary signal SFC. The boundary signal SFC may be provided by the driving controller 200.

BFI of the data signal DATA means a period for a black frame insertion of the data signal DATA. The black frame insertion period BFI of the data signal DATA may be a period for resetting the data signal DATA. When the black frame is inserted into the data signal DATA, the output buffers of the data driver 500 outputting the data voltages to the display panel 100 may be reset. For example, the black frame insertion period BFI may be defined as a period from a first clock pulse after the boundary signal SFC is changed to the high level to a right next clock pulse of the first clock pulse.

In FIG. 4A, the data signal DATA represents a black grayscale in a first active period prior to the vertical blank period and the data signal DATA represents a white grayscale in a second active period after the vertical blank period. During the vertical blank period, the data signal DATA is set to a preset grayscale. Although the preset grayscale is set to 127 grayscale in the present exemplary embodiment, the preset grayscale may be set to any grayscale between zero (a minimum grayscale) to 255 grayscale (a maximum grayscale). For example, the preset grayscale may be set to a zero grayscale to prevent consuming unnecessary power during the vertical blank period. For example, the preset grayscale may be set to 127 grayscale which is a central grayscale to ensure that the difference is not great from normal grayscales in the first active period and in the second active period.

The data signal DATA in FIG. 4A has a sequence as follows. The data signal DATA represents the black grayscale during the first active period and the data signal DATA is rapidly changed to 127 grayscale when the vertical blank period starts (at moment A). In the moment A, the load of the data voltage of the data driver 500 may be rapidly changed so that a ripple component is generated. And then, the data signal DATA represents 127 grayscale during the vertical blank period and the data signal DATA is rapidly changed to the black grayscale when the BFI starts (at moment B). And then, since the level of the inversion control signal POL is changed, the data signal DATA is rapidly changed to negative 127 grayscale at the end of the BFI (at moment C). And then, the data signal DATA is rapidly changed to the white grayscale when the vertical blank period ends and the second active period starts (at moment D).

As explained above, the data signal DATA may be rapidly changed at the moments A, B, C and D. The rapid change of the data signal DATA may generate the rapid change of the load of the data voltage. If the rapid changing patterns of the data signal DATA are repeated in every frame, the change of the load of the data voltage may generate peak currents in every frame. Due to the peak currents, driving noise of the display apparatus may be generated, the display quality of the display panel may deteriorate and the power consumption of the display apparatus may increase.

Figure 4B:
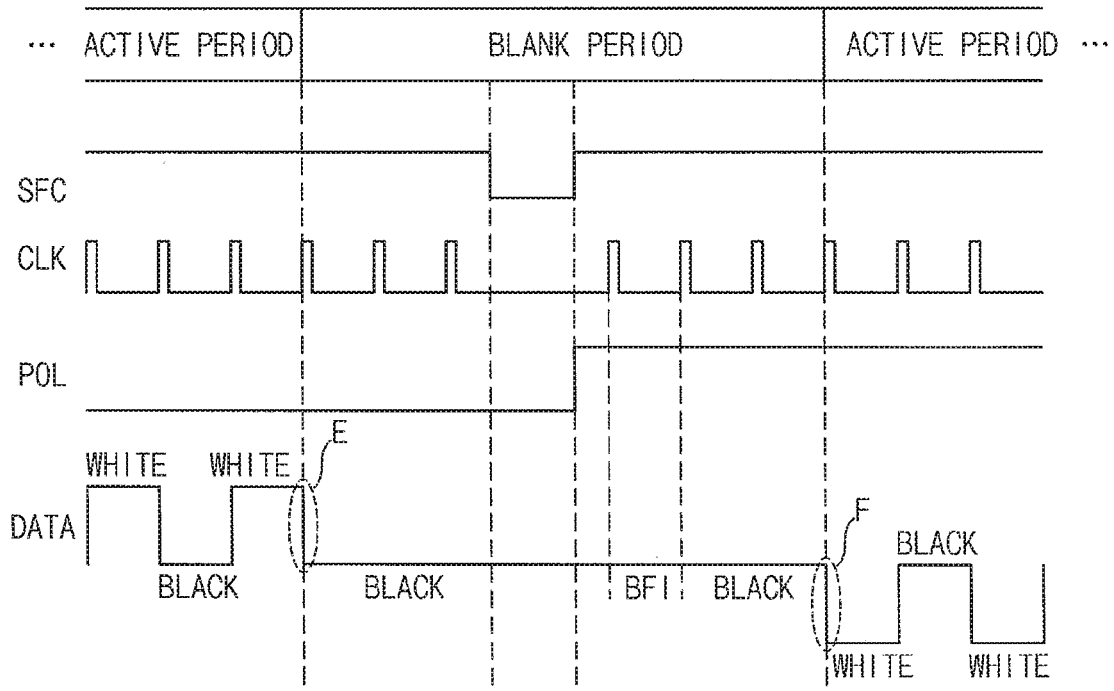
FIG. 4B is a timing diagram illustrating the change of the load generated at the data driver of FIG. 1 by the polarity inversion of the data voltage and the difference between the level of the data voltage and the level of the dummy data voltage according to an exemplary embodiment of the inventive concept.

FIG. 4B is a timing diagram illustrating the change of the load generated at the data driver 500 of FIG. 1 by the polarity inversion of the data voltage and a difference between the level of the data voltage and the level of the dummy data voltage according to an exemplary embodiment of the inventive concept.

Referring to FIGS. 1 to 4B, the data signal DATA swings between the white grayscale and the black grayscale in the first active period prior to the vertical blank period and in the second active period after the vertical blank period. During the vertical blank period, the data signal DATA is set to the black grayscale.

The data signal DATA in FIG. 4B has a sequence as follows. The data signal DATA sequentially represents the white grayscale, the black grayscale and the white grayscale during the first active period so that the load of the data driver 500 may be greatly changed. And then, the data signal DATA is rapidly changed to the black grayscale when the vertical blank period starts (at moment E). And then, the data signal DATA is rapidly changed to the white grayscale when the vertical blank period ends and the second active period starts (at moment F). And then, the data signal DATA sequentially represents the white grayscale, the black grayscale and the white grayscale during the second active period so that the load of the data driver 500 may be greatly changed.

As explained above, the data signal DATA is rapidly changed at the moments E and F. The rapid change of the data signal DATA may generate a rapid change in the load of the data voltage. If the rapid changing patterns of the data signal DATA are repeated in every frame, the change of the load of the data voltage may generate peak currents in every frame. Due to the peak currents, driving noise of the display apparatus may be generated, the display quality of the display panel may deteriorate and the power consumption of the display apparatus may increase.

Figure 5:
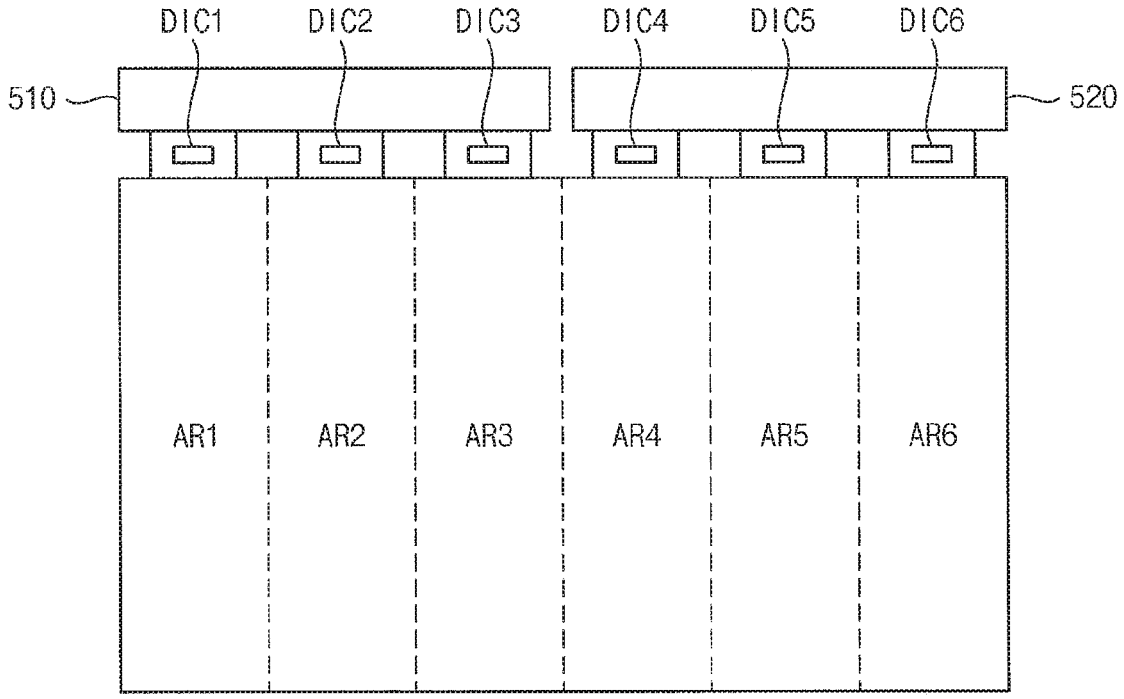
FIG. 5 is a plan view illustrating a plurality of display blocks (e.g.., parts of the display panel) of the display panel of FIG. 1 and a plurality of driving blocks (e.g., driving circuits) of the data driver of FIG. 1.
Figure 6:
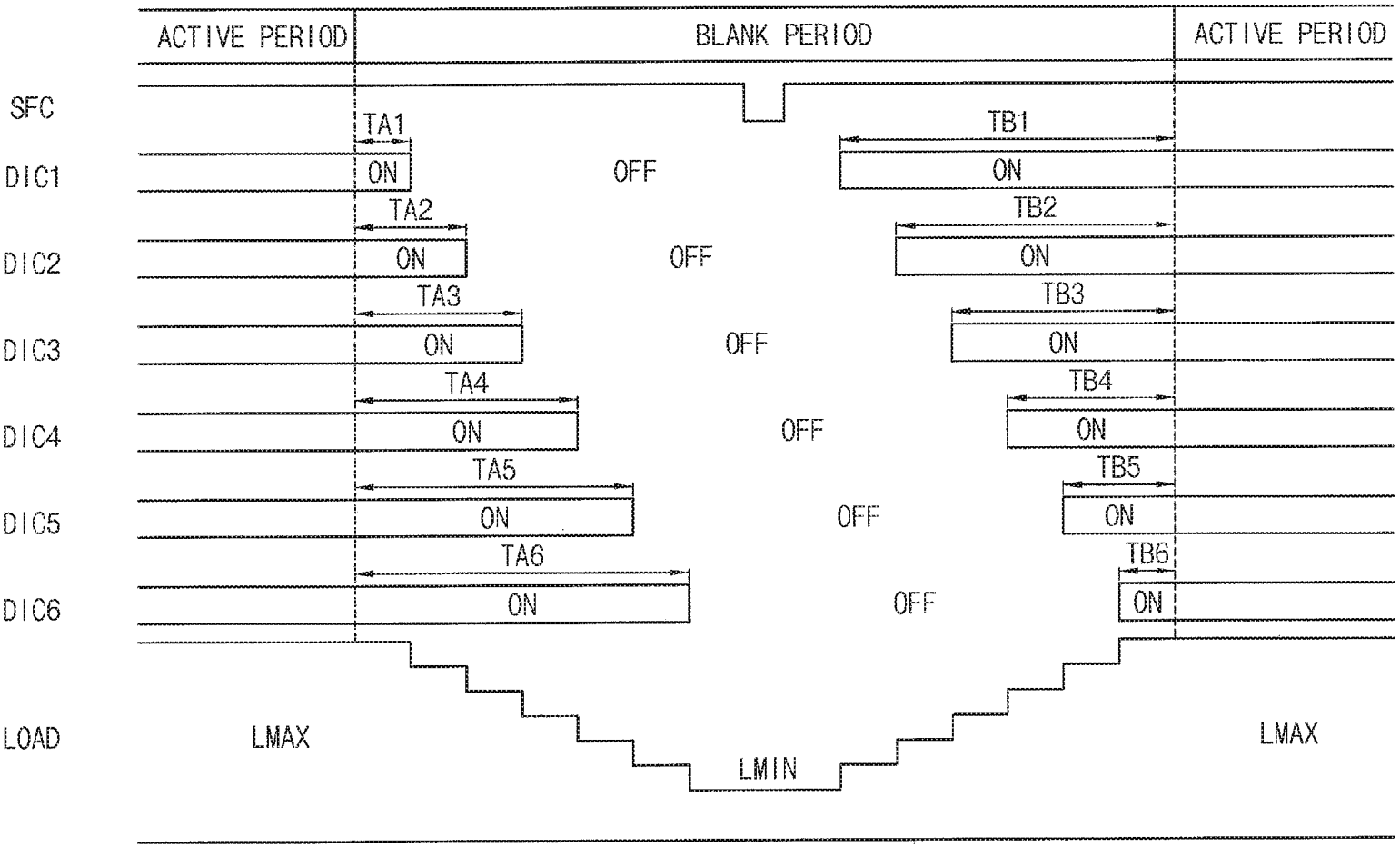
FIG. 6 is a timing diagram illustrating operation of the driving blocks of FIG. 5 and the load of the data driver.

FIG. 5 is a plan view illustrating a plurality of display blocks AR1 to AR6 (e.g., pixel areas) of the display panel 100 of FIG. 1 and a plurality of driving blocks DIC1 to DIC6 (e.g., data driving circuits) of the data driver 500 of FIG. 1. FIG. 6 is a timing diagram illustrating operation of the driving blocks DIC1 to DIC6 of FIG. 5 and the load of the data driver 500.

Referring to FIGS. 1 to 6, the display panel 100 may include the display blocks AR1 to AR6. The display blocks AR1 to AR6 may extend in the second direction D2 which is parallel with the extending direction of the data lines DL. The display blocks AR1 to AR6 may be disposed along the first direction D1 which is parallel with the extending direction of the gate lines GL.

The data driver 500 may include the driving blocks DIC1 to DIC6. The driving blocks DIC1 to DIC6 may be disposed along the first direction D1 which is parallel with the extending direction of the gate lines GL. Boundaries of the display blocks AR1 to AR6 may be determined by the data lines DL connected to the driving blocks DIC1 to DIC6. Thus, the number of the driving blocks DIC1 to DIC6 may be equal to the number of the display blocks AR1 to AR6.

For example, the data driver 500 may include a first data printed circuit board 510 and a second data printed circuit board 520. The first data printed circuit board 510 may be connected to the display panel 100 through flexible printed circuit boards. The second data printed circuit board 520 may be connected to the display panel 100 through the flexible printed circuit boards. For example, the driving blocks DIC1 to DIC6 may be data integrated circuit chips. The data integrated circuit chips may be disposed on the flexible printed circuit boards.

Although the display panel 100 is illustrated as including six display blocks and the data driver 500 is illustrated as including six driving blocks in FIG. 5, the present inventive concept is not limited to any particular number of display blocks or any particular number of driving blocks.

In an exemplary embodiment of the inventive concept, at least two driving blocks among the driving blocks DIC1 to DIC6 have different turn off timings or different turn on timings in the vertical blank period.

For example, three driving blocks among the driving blocks DIC1 to DIC6 may be turned off in a first timing and the other three driving blocks among the driving blocks DIC1 to DIC6 may be turned off in a second timing. For example, two driving blocks among the driving blocks DIC1 to DIC6 may be turned off in a first timing, two other two driving blocks among the driving blocks DIC1 to DIC6 may be turned off in a second timing and the remaining other two driving blocks among the driving blocks DIC1 to DIC6 may be turned off in a third timing.

For example, as shown in FIG. 6, each of the driving blocks DIC1 to DIC6 are turned off at different timings. In the vertical blank period, the first driving block DIC1 maintains a turn on status during a first turn on period TA1 and is turned off after the first turn on period TA1. In the vertical blank period, the second driving block DIC2 maintains a turn on status during a first turn on period TA2 different from the first turn on period TA1 of the first driving block DIC1 and is turned off after the first turn on period TA2. In the vertical blank period, the third driving block DIC3 maintains a turn on status during a first turn on period TA3 different from the first turn on periods TA1 and TA2 of the first and second driving blocks DIC1 and DIC2 and is turned off after the first turn on period TA3. In the vertical blank period, the fourth driving block DIC4 maintains a turn on status during a first turn on period TA4 different from the first turn on periods TA1, TA2 and TA3 of the first, second and third driving blocks DIC1, DIC2 and DIC3 and is turned off after the first turn on period TA4. In the vertical blank period, the fifth driving block DIC5 maintains a turn on status during a first turn on period TA5 different from the first turn on periods TA1, TA2, TA3 and TA4 of the first, second, third and fourth driving blocks DIC1, DIC2, DIC3 and DIC4 and is turned off after the first turn on period TA5. In the vertical blank period, the sixth driving block DIC6 maintains a turn on status during a first turn on period TA6 different from the first turn on periods TA1, TA2, TA3, TA4 and TA5 of the first, second, third, fourth and fifth driving blocks DIC1, DIC2, DIC3, DIC4 and DIC5 and is turned off after the first turn on period TA6.

In an embodiment, the first turn on periods become gradually larger such that TA1<TA2<TA3<TA4<TA5<TA6. In an embodiment, the driving blocks output data voltages to the data lines during the active period and output dummy data voltages to the dummy data lines during turn on periods of vertical blank period. For example, the first driving block DIC1 outputs data voltages to a first group of data lines during a first active period, outputs dummy data voltages to a first group of the dummy data lines during the first turn on period TA1 of the vertical blank period, does not output data voltages or dummy data voltages during a turn off period after the first turn off period TA1, outputs dummy data voltages to the first group of dummy data lines during the second turn on period TB1 of the vertical blank period, and outputs data voltages to the first group of data lines during the second active period after the vertical blank period. In an embodiment, the second turn on periods become gradually smaller such that TB1>TB2>TB3>TB4>TB5>TB6. In an embodiment, TA1=TB6, TA2=TB5, TA3=TB4, TA4=TB3, TA5=TB2, and TA6=TB1.

As explained above, the driving blocks DIC1 to DIC6 of the data driver 500 may be sequentially turned off during the vertical blank period. In an exemplary embodiment, the sequence of turning off of the driving blocks DIC1 to DIC6 is different from the exemplary embodiment of FIG. 6.

For example, three driving blocks among the driving blocks DIC1 to DIC6 may be turned on in a first timing and the other three driving blocks among the driving blocks DIC1 to DIC6 may be turned on in a second timing. For example, two driving blocks among the driving blocks DIC1 to DIC6 may be turned on in a first timing, two other driving blocks among the driving blocks DIC1 to DIC6 may be turned on in a second timing and the remaining other two driving blocks among the driving blocks DIC1 to DIC6 may be turned on in a third timing.

For example, as shown in FIG. 6, each of the driving blocks DIC1 to DIC6 may be turned on in different timings. In the vertical blank period, the first driving block DIC1 is turned on again and maintains the turn on status during a second turn on period TB1. In the vertical blank period, the second driving block DIC2 is turned on again and maintains the turn on status during a second turn on period TB2 different from the second turn on period TB1 of the first driving block DIC1. In the vertical blank period, the third driving block DIC3 is turned on again and maintains the turn on status during a second turn on period TB3 different from the second turn on periods TB1 and TB2 of the first and second driving blocks DIC1 and DIC2. In the vertical blank period, the fourth driving block DIC4 is turned on again and maintains the turn on status during a second turn on period TB4 different from the second turn on periods TB1, TB2 and TB3 of the first, second and third driving blocks DIC1, DIC2 and DIC3. In the vertical blank period, the fifth driving block DIC5 is turned on again and maintains the turn on status during a second turn on period TB5 different from the second turn on periods TB1, TB2, TB3 and TB4 of the first, second, third and fourth driving blocks DIC1, DIC2, DIC3 and DIC4. In the vertical blank period, the sixth driving block DIC6 is turned on again and maintains the turn on status during a second turn on period TB6 different from the second turn on periods TB1, TB2, TB3, TB4 and TB5 of the first, second, third, fourth and fifth driving blocks DIC1, DIC2, DIC3, DIC4 and DIC5.

As explained above, the driving blocks DIC1 to DIC6 of the data driver 500 may be sequentially turned on during the vertical blank period. In an exemplary embodiment, the sequence of turning on of the driving blocks DIC1 to DIC6 is different from the exemplary embodiment of FIG. 6.

As shown in FIG. 6, in an exemplary embodiment, the driving blocks DIC1 to DIC6 have the same length of turn off periods in the vertical blank period.

The driving blocks DIC1 to DIC6 respectively have the first turn on periods TA1 to TA6, the second turn on periods TB1 to TB6 and the turn off periods between the first turn on periods TA1 to TA6 and the second turn on periods TB1 to TB6. Thus, the sequence of turning off of the driving blocks DIC1 to DIC6 coincides with the sequence of turning on of the driving blocks DIC1 to DIC6.

In an exemplary embodiment, the driving blocks DIC1 to DIC6 respectively output last data voltages of the first active period which is prior to the vertical blank period to the dummy area of the display panel 100 during the first turn on periods TA1 to TA6. Thus, the load of the data driver 500 is not changed at the moment when the vertical blank period starts.

In an exemplary embodiment, the driving blocks DIC1 to DIC6 respectively output first data voltages of the second active period which is after the vertical blank period during the second turn on periods TB1 to TB6. Thus, the load of the data driver 500 does change at the moment when the vertical blank period ends.

When all of the driving blocks DIC1 to DIC6 are operated, the load of the data driver 500 may have the maximum load LMAX. When all of the driving blocks DIC1 to DIC6 are turned off, the load of the data driver 500 may have the minimum load LMIN.

In the present exemplary embodiment, the driving blocks DIC1 to DIC6 respectively have the turn off periods when the respective driving blocks DIC1 to DIC6 are turned off in the vertical blank period. When the driving blocks DIC1 to DIC6 are simultaneously turned off, the load of the data driver 500 may rapidly change so that noise is generated at the display apparatus due to the rapid change of the load of the data driver 500. Thus, in the present exemplary embodiment, the driving blocks DIC1 to DIC6 are not simultaneously turned off in the vertical blank period. For example, the driving blocks DIC1 to DIC6 may be sequentially turned off in the vertical blank period. Thus, the load of the data driver 500 may be gradually changed from the maximum load LMAX to the minimum load LMIN.

In the present exemplary embodiment, the driving blocks DIC1 to DIC6 are respectively turned on again after the turn off periods in the vertical blank period. When the driving blocks DIC1 to DIC6 are simultaneously turned on, the load of the data driver 500 may rapidly change so that noise is generated at the display apparatus due to the rapid change of the load of the data driver 500. Thus, in the present exemplary embodiment, the driving blocks DIC1 to DIC6 are not simultaneously turned on in the vertical blank period. For example, the driving blocks DIC1 to DIC6 are sequentially turned on in the vertical blank period. Thus, the load of the data driver 500 may be gradually changed from the minimum load LMIN to the maximum load LMAX.

Figure 7:
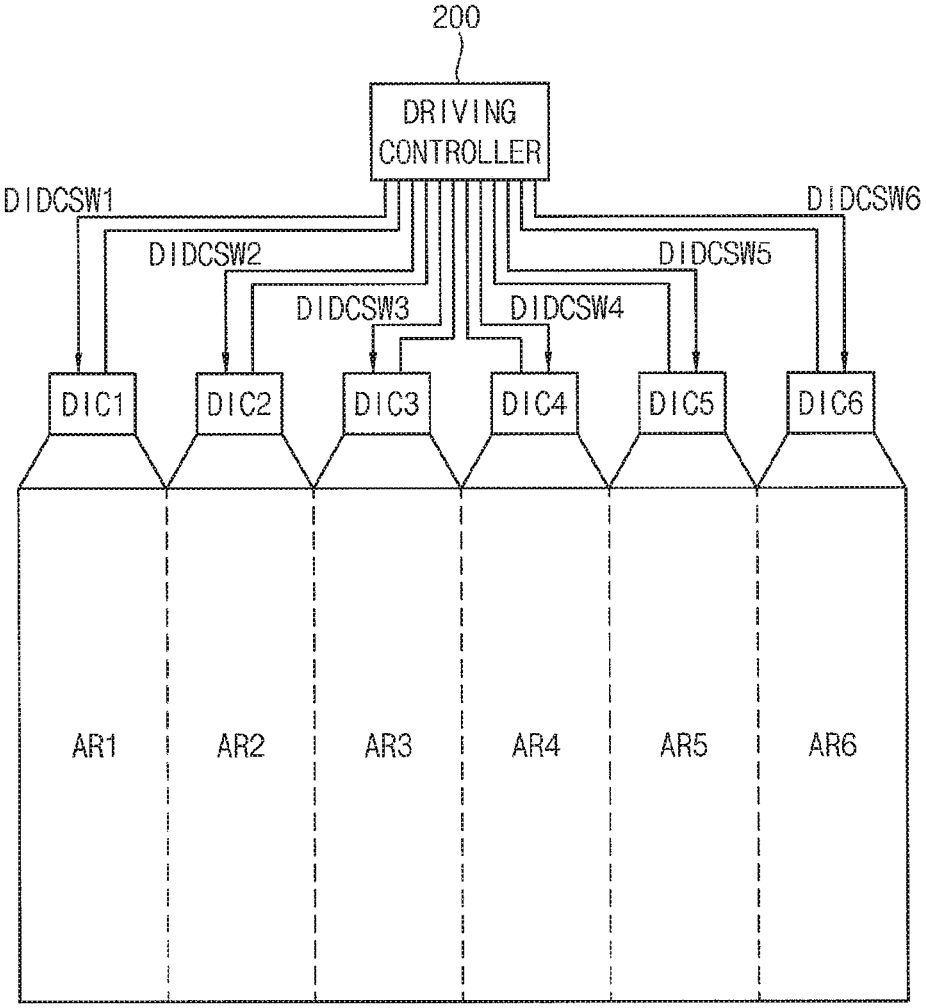
FIG. 7 is a conceptual diagram illustrating operation of the driving controller of FIG. 1 and operation of the data driver of FIG. 1.
Figure 8:
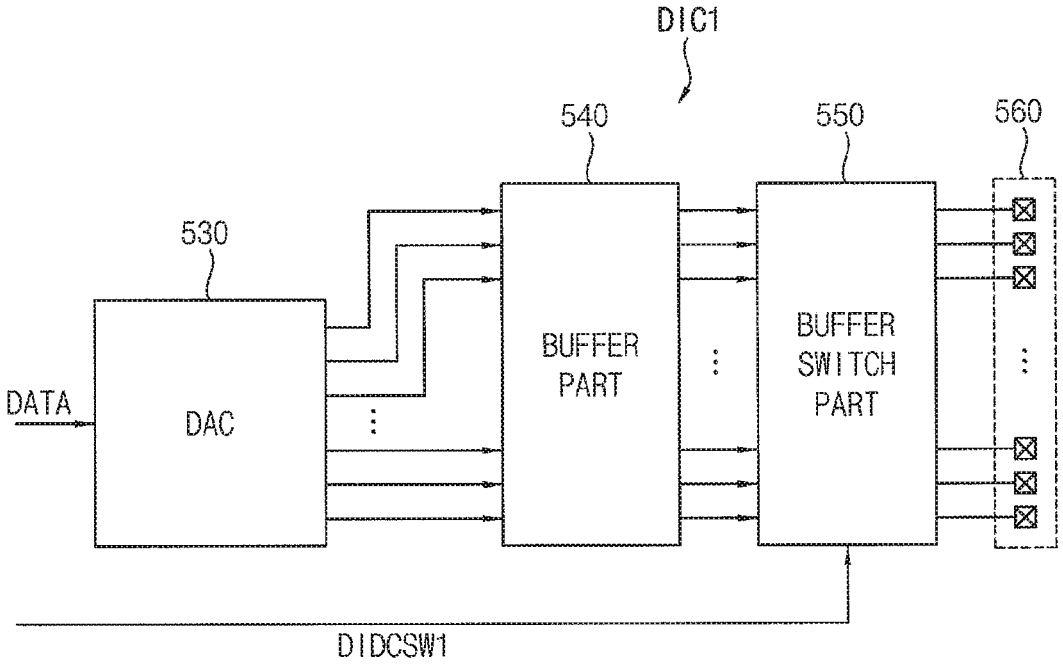
FIG. 8 is a block diagram illustrating a structure of the driving block of FIG. 5 according to an exemplary embodiment of the inventive concept.
Figure 9:
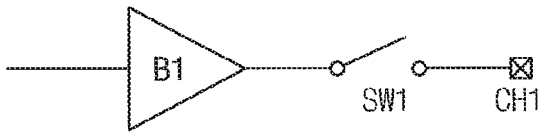
FIG. 9 is a circuit diagram illustrating a portion of the driving block of FIG. 5 according to an exemplary embodiment of the inventive concept.

FIG. 7 is a conceptual diagram illustrating an operation of the driving controller 200 of FIG. 1 and operation of the data driver 500 of FIG. 1. FIG. 8 is a block diagram illustrating a structure of the driving blocks DIC1 to DIC6 of FIG. 5. FIG. 9 is a circuit diagram illustrating a portion of the driving blocks DIC1 to DIC6 of FIG. 5.

Referring to FIGS. 1 to 9, the driving blocks DIC1 to DIC6 respectively include structures to turn on and off the driving blocks DIC1 to DIC6.

Although the first driving block DIC1 is illustrated and the other driving blocks DIC2 to DIC6 are not illustrated in FIG. 8, the other driving blocks DIC2 to DIC6 may have structures substantially the same as the structure of the first driving block DIC1.

The first driving block DIC1 includes a digital to analog converter (DAC) 530, a buffer part 540 (e.g., a buffer circuit), a buffer switch part 550 (e.g., a switching circuit) and a channel part 560 (e.g., one or more channels). The DAC 530 receives the data signals DATA having a digital type and converts the data signals DATA into the data voltages having an analog type. The buffer part 540 includes a plurality of output buffers outputting the data voltages to the data lines. The buffer switch part 550 includes a plurality of output buffer switches disposed between the data lines and the output buffers and enables or disables the connection between the output buffers and the data lines DL. The channel part 560 includes a plurality of channels CH connecting the output buffers to the data lines DL.

When all of the connections between the output buffers and the data lines DL are disabled by the buffer switch part 550, the first driving block DIC1 is turned off. When all of the connections between the output buffers and the data lines DL are enabled by the buffer switch part 550, the first driving block DIC1 is turned on.

The buffer switch part 550 enables the connections between the output buffers and the data lines DL in the active period. The buffer switch part 550 enables the connections between the output buffers and the data lines DL in the first turn on period (e.g. TA1) and the second turn on period (e.g. TB1). The buffer switch part 550 disables the connections between the output buffers and the data lines DL in the turn off period.

For example, a first output buffer B1 outputs the data voltage for a first data line to a first channel CH1 which is connected to the first data line. A first output buffer switch SW1 is disposed between the first output buffer B1 and the first channel CH1 and enables or disables a connection between the first output buffer B1 and the first channel CH1.

In the present exemplary embodiment, the driving controller 200 outputs a first switching signal DIDCSW1 for controlling the output buffer switches of the first driving block DIC1 to the first driving block DIC1. The driving controller 200 outputs a second switching signal DIDCSW2 for controlling the output buffer switches of the second driving block DIC2 to the second driving block DIC2. As shown in FIG. 6, the turn off timing and the turn on timing of the first driving block DIC1 may be earlier than the turn off timing and the turn on timing of the second driving block DIC2. Accordingly, the first switching signal DIDCSW1 has a timing earlier than a timing of the second switching signal DIDCSW2. For example, the second switching signal DIDCSW2 may be generated by delaying the first switching signal DIDCSW1. Similarly, the driving controller 200 outputs a third switching signal DIDCSW3 for controlling the output buffer switches of the third driving block DIC3 to the third driving block DIC3, the driving controller 200 outputs a fourth switching signal DIDCSW4 for controlling the output buffer switches of the fourth driving block DIC4 to the fourth driving block DIC4, the driving controller 200 outputs a fifth switching signal DIDCSW5 for controlling the output buffer switches of the fifth driving block DIC5 to the fifth driving block DIC5 and the driving controller 200 outputs a sixth switching signal DIDCSW6 for controlling the output buffer switches of the sixth driving block DIC6 to the sixth driving block DIC6.

According to the present exemplary embodiment, in the vertical blank period, the driving blocks DIC1 to DIC6 are turned on and off at different timings in a vertical blank period so that the change of the load may be minimized due to the polarity inversion of the data voltage and the difference between the level of the data voltage and the level of the dummy data voltage.

Thus, noise generated by the polarity inversion of the data voltage and the difference between the level of the data voltage and the level of the dummy data voltage may be reduced.

In addition, a display defect generated by voltage ripple in the vertical blank period may be prevented so that the display quality of the display panel 100 may be enhanced.

In addition, the change of the load generated by the polarity inversion of the data voltage and the difference between the level of the data voltage and the level of the dummy data voltage may be minimized so that power consumption of the display apparatus may be reduced.

Figure 10:
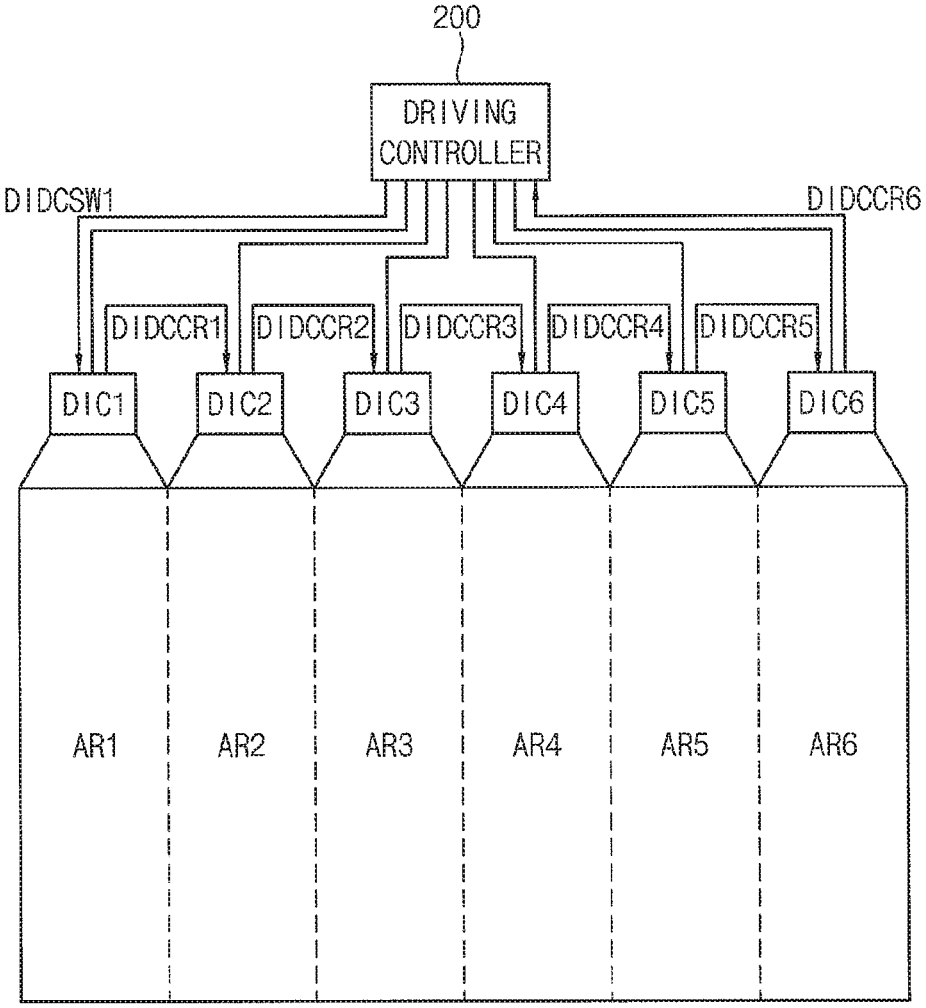
FIG. 10 is a conceptual diagram illustrating operation of a driving controller and operation of a data driver of a display apparatus according to an exemplary embodiment of the present inventive concept.
Figure 11:
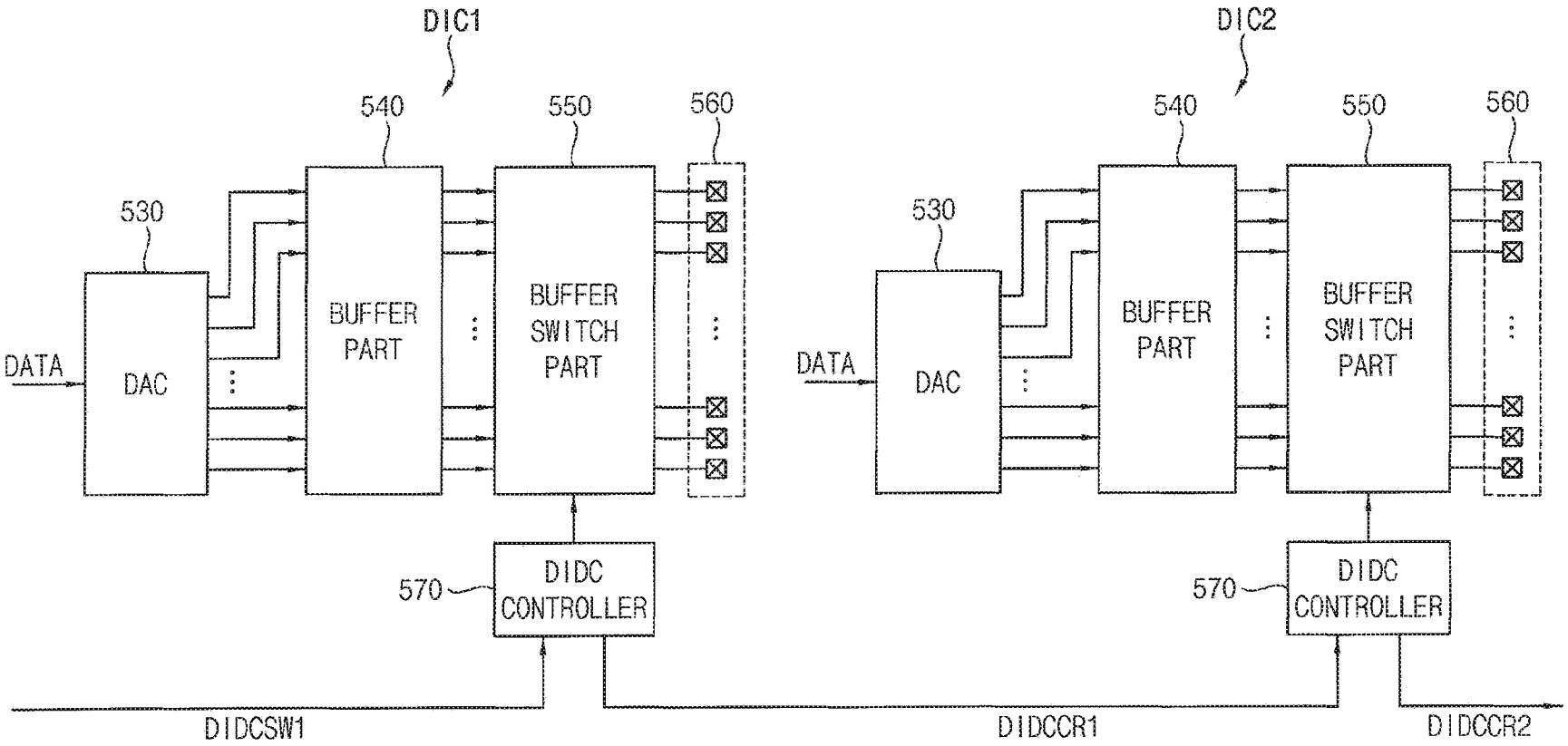
FIG. 11 is a circuit diagram illustrating a portion of a driving block of FIG. 10 according to an exemplary embodiment of the inventive concept.

FIG. 10 is a conceptual diagram illustrating an operation of a driving controller 200 and operation of a data driver 500 of a display apparatus according to an exemplary embodiment of the present inventive concept. FIG. 11 is a circuit diagram illustrating a portion of a driving block of FIG. 10.

The display apparatus and the method of driving the display panel according to the present exemplary embodiment is substantially the same as the display apparatus and the method of driving the display panel of the previous exemplary embodiment explained referring to FIGS. 1 to 9 except for the switching operation of the output buffer switch. Thus, the same reference numerals will be used to refer to the same or like parts as those described in the previous exemplary embodiment of FIGS. 1 to 9 and any repetitive explanation concerning the above elements will be omitted.

Referring to FIGS. 1 to 6, 10 and 11, the display apparatus includes a display panel 100 and a display panel driver. The display panel driver includes a driving controller 200, a gate driver 300, a gamma reference voltage generator 400 and a data driver 500.

The driving period of the display panel 100 includes the active period when the image is displayed in the active area of the display panel 100 and the vertical blank period when the image is not displayed in the active area.

The display panel 100 may include the display blocks AR1 to AR6. The data driver 500 may include the driving blocks DIC1 to DIC6.

In an exemplary embodiment of the inventive concept, at least two driving blocks among the driving blocks DIC1 to DIC6 have different turn off timings or different turn on timings in the vertical blank period.

The driving blocks DIC1 to DIC6 may respectively have the first turn on periods TA1 to TA6, the second turn on periods TB1 to TB6 and the turn off periods between the first turn on periods TA1 to TA6 and the second turn on periods TB1 to TB6.

The driving blocks DIC1 to DIC6 may respectively include structures to turn on and off the driving blocks DIC1 to DIC6.

Although the first driving block DIC1 and the second driving block DIC2 are illustrated and the other driving blocks DIC3 to DIC6 are not illustrated in FIG. 11, the other driving blocks DIC3 to DIC6 may have structures substantially the same as the structures of the first driving block DIC1 and the second driving block DIC2.

The first driving block DIC1 includes a digital to analog converter (DAC) 530, a buffer part 540 (e.g., a buffer circuit), a buffer switch part 550 (e.g., a switching circuit) and a channel part 560 (e.g., one or more channels). The DAC 530 receives the data signals DATA having a digital type and converts the data signals DATA into the data voltages having an analog type. The buffer part 540 includes a plurality of output buffers outputting the data voltages to the data lines. The buffer switch part 550 includes a plurality of output buffer switches disposed between the data lines and the output buffers and enables or disables the connections between the output buffers and the data lines DL. The channel part 560 includes a plurality of channels CH connecting the output buffers to the data lines DL.

In the present exemplary embodiment, the driving controller 200 outputs the first switching signal DIDCSW1 for controlling the output buffer switches of the first driving block DIC1 to the first driving block DIC1.

The first driving block DIC1 further includes a switching controller 570 (e.g., a control circuit) controlling the turn on and turn off of the buffer switch part 550.

The switching controller 570 of the first driving block DIC1 receives a first switching signal DIDCSW1 from the driving controller 200, controls the buffer switch part 550 of the first driving block DIC1, generates a second switching signal DIDCCR1 for controlling the buffer switch part 550 of the second driving block DIC2 and outputs the second switching signal DIDCCR1 to a switching controller 570 of the second driving block DIC2. For example, the switching controller 570 of the first driving block DIC1 may control the buffer switch part 550 of the first driving block DIC1 using the first switching signal DIDCSW1. The first switching signal DIDCSW1 may be a start signal generated by the driving controller 200 and the second switching signal DIDCCR1 may be a carry signal generated by the start signal.

The switching controller 570 of the second driving block DIC2 receives the second switching signal DIDCCR1 from the switching controller 570 of the first driving block DIC1, controls the buffer switch part 550 of the second driving block DIC2, generates a third switching signal DIDCCR2 for controlling the buffer switch part 550 of the third driving block DIC3 and outputs the third switching signal DIDCCR2 to a switching controller 570 of the third driving block DIC3. For example, the switching controller 570 of the second driving block DIC2 may control the buffer switch part 550 of the second driving block DIC1 using the second switching signal DIDCCR1. The third switching signal DIDCCR2 may be a carry signal generated by the second switching signal DIDCCR1.

Switching controllers 570 of the third to fifth driving blocks DIC3 to DICS may operate in the same way as the switching controller 570 of the second driving block DIC2.

A switching controller 570 of the sixth driving block DIC6 receives a sixth switching signal DIDCCR5 from the switching controller 570 of the fifth driving block DIC5, controls the buffer switch part 550 of the sixth driving block DIC6, generates a terminating signal DIDCCR6 based on the sixth switching signal DIDCCR5 and outputs the terminating signal DIDCCR6 to the driving controller 200. In an exemplary embodiment, the driving controller 200 determines whether the buffer switch parts 550 of the driving blocks DIC1 to DIC6 normally operate based on the terminating signal DIDCCR6.

According to the present exemplary embodiment, in the vertical blank period, the driving blocks DIC1 to DIC6 are turned on and off at different timings in a vertical blank period so that the change of the load may be minimized due to the polarity inversion of the data voltage and the difference between the level of the data voltage and the level of the dummy data voltage.

Thus, noise generated by the polarity inversion of the data voltage and the difference between the level of the data voltage and the level of the dummy data voltage may be reduced.

In addition, a display defect generated by voltage ripple in the vertical blank period may be prevented so that the display quality of the display panel 100 may be enhanced.

In addition, the change of the load generated by the polarity inversion of the data voltage and the difference between the level of the data voltage and the level of the dummy data voltage may be minimized so that power consumption of the display apparatus may be reduced.

Figure 12:
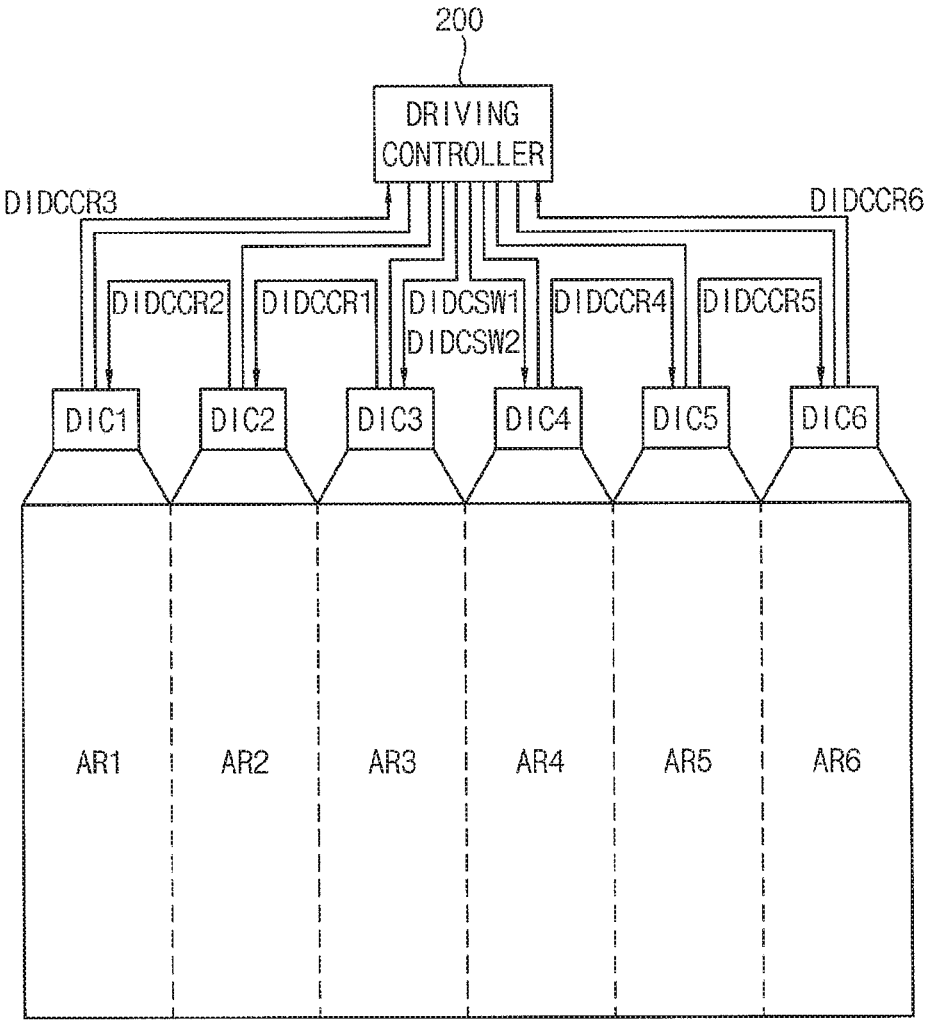
FIG. 12 is a conceptual diagram illustrating operation of a driving controller and operation of a data driver of a display apparatus according to an exemplary embodiment of the present inventive concept.

FIG. 12 is a conceptual diagram illustrating operation of a driving controller and operation of a data driver of a display apparatus according to an exemplary embodiment of the present inventive concept.

The display apparatus and the method of driving the display panel according to the present exemplary embodiment is substantially the same as the display apparatus and the method of driving the display panel of the previous exemplary embodiment explained referring to FIGS. 10 and 11 except for the switching operation of the output buffer switch. Thus, the same reference numerals will be used to refer to the same or like parts as those described in the previous exemplary embodiment of FIGS. 10 and 11 and any repetitive explanation concerning the above elements will be omitted.

Referring to FIGS. 1 to 6, 11 and 12, the display apparatus includes a display panel 100 and a display panel driver. The display panel driver includes a driving controller 200, a gate driver 300, a gamma reference voltage generator 400 and a data driver 500.

The driving period of the display panel 100 includes the active period when the image is displayed in the active area of the display panel 100 and the vertical blank period when the image is not displayed in the active area.

The display panel 100 may include the display blocks AR1 to AR6. The data driver 500 may include the driving blocks DIC1 to DIC6.

In an exemplary embodiment of the inventive concept, at least two driving blocks among the driving blocks DIC1 to DIC6 have different turn off timings or different turn on timings in the vertical blank period.

The driving blocks DIC1 to DIC6 may respectively have the first turn on periods TA1 to TA6, the second turn on periods TB1 to TB6 and the turn off periods between the first turn on periods TA1 to TA6 and the second turn on periods TB1 to TB6.

The driving blocks DIC1 to DIC6 may respectively include structures to turn on and off the driving blocks DIC1 to DIC6.

Although the first driving block DIC1 and the second driving block DIC2 are illustrated and the other driving blocks DIC3 to DIC6 are not illustrated in FIG. 11, the other driving blocks DIC3 to DIC6 may have the structures substantially the same as the structures of the first driving block DIC1 and the second driving block DIC2.

The first driving block DIC1 includes a digital to analog converter (DAC) 530, a buffer part 540 (e.g., a buffer circuit), a buffer switch part 550 (e.g., a switching circuit) and a channel part 560 (e.g., one or more channels). The DAC 530 receives the data signals DATA having a digital type and converts the data signals DATA into the data voltages having an analog type. The buffer part 540 includes a plurality of output buffers outputting the data voltages to the data lines. The buffer switch part 550 includes a plurality of output buffer switches disposed between the data lines and the output buffers and enables or disables the connections between the output buffers and the data lines DL. The channel part 560 includes a plurality of channels CH connecting the output buffers to the data lines DL.

In the present exemplary embodiment, the driving controller 200 outputs the first switching signal DIDCSW1 for controlling the output buffer switches of the third driving block DIC3 to the third driving block DIC3.

The third driving block DIC3 may further include a switching controller 570 controlling the turn on and turn off of the buffer switch part 550.

The switching controller 570 of the third driving block DIC3 receives the first switching signal DIDCSW1 from the driving controller 200, controls the buffer switch part 550 of the third driving block DIC3, generates a second switching signal DIDCCR1 for controlling the buffer switch part 550 of the second driving block DIC2 and outputs the second switching signal DIDCCR1 to a switching controller 570 of the second driving block DIC2. The first switching signal DIDCSW1 may be a first start signal generated by the driving controller 200 and the second switching signal DIDCCR1 may be a carry signal generated from the first start signal.

The switching controller 570 of the second driving block DIC2 receives the second switching signal DIDCCR1 from the switching controller 570 of the first driving block DIC1, controls the buffer switch part 550 of the second driving block DIC2, generates a third switching signal DIDCCR2 for controlling the buffer switch part 550 of the first driving block DIC1 and outputs the third switching signal DIDCCR2 to a switching controller 570 of the first driving block DIC1. The third switching signal DIDCCR2 may be a carry signal generated from the second switching signal DIDCCR1.

The switching controller 570 of the first driving block DIC1 receives the third switching signal DIDCCR2 from the switching controller 570 of the second driving block DIC2, controls the buffer switch part 550 of the first driving block DIC1, generates a first terminating signal DIDCCR3 based on the third switching signal DIDCCR2 and outputs the first terminating signal DIDCCR3 to the driving controller 200. In an exemplary embodiment, the driving controller 200 determines whether the buffer switch parts 550 of the first to third driving blocks DIC1 to DIC3 normally operate based on the first terminating signal DIDCCR3.

The switching controller 570 of the fourth driving block DIC4 receives a fourth switching signal DIDCSW2 from the driving controller 200, controls the buffer switch part 550 of the fourth driving block DIC4, generates a fifth switching signal DIDCCR4 for controlling the buffer switch part 550 of the fourth driving block DIC4 and outputs the fifth switching signal DIDCCR4 to a switching controller 570 of the fifth driving block DICS. The fourth switching signal DIDCSW2 may be a second start signal generated by the driving controller 200 and the fifth switching signal DIDCCR4 may be a carry signal generated from the second start signal.

The switching controller 570 of the fifth driving block DIC5 receives the fifth switching signal DIDCCR4 from the switching controller 570 of the fourth driving block DIC4, controls the buffer switch part 550 of the fifth driving block DIC5, generates a sixth switching signal DIDCCR5 for controlling the buffer switch part 550 of the sixth driving block DIC6 and outputs the sixth switching signal DIDCCR5 to a switching controller 570 of the sixth driving block DIC6. The sixth switching signal DIDCCR5 may be a carry signal generated from the fifth switching signal DIDCCR4.

The switching controller 570 of the sixth driving block DIC6 receives the sixth switching signal DIDCCR5 from the switching controller 570 of the fifth driving block DIC5, controls the buffer switch part 550 of the sixth driving block DIC6, generates a second terminating signal DIDCCR6 based on the sixth switching signal DIDCCR5 and outputs the second terminating signal DIDCCR6 to the driving controller 200. In an embodiment, the driving controller 200 determines whether the buffer switch parts 550 of the fourth to sixth driving blocks DIC4 to DIC6 normally operate based on the first terminating signal DIDCCR3.

According to the present exemplary embodiment, in the vertical blank period, the driving blocks DIC1 to DIC6 are turned on and off at different timings in a vertical blank period so that the change of the load may be minimized due to the polarity inversion of the data voltage and the difference between the level of the data voltage and the level of the dummy data voltage.

Thus, noise generated by the polarity inversion of the data voltage and the difference between the level of the data voltage and the level of the dummy data voltage may be reduced.

In addition, a display defect generated by a voltage ripple in the vertical blank period may be prevented so that the display quality of the display panel 100 may be enhanced.

In addition, the change of the load generated by the polarity inversion of the data voltage and the difference between the level of the data voltage and the level of the dummy data voltage may be minimized so that power consumption of the display apparatus may be reduced.

According to at least one exemplary embodiment of the display apparatus and the method of driving the display panel, the driving blocks are turned on and off at different timings in the vertical blank period so that noise of the display apparatus may be reduced, the display quality of the display panel may be enhanced and power consumption of the display apparatus may be reduced.

Although a few exemplary embodiments of the present inventive concept have been described, those skilled in the art will readily appreciate that many modifications are possible in the exemplary embodiments without materially departing from the present inventive concept. Accordingly, all such modifications are intended to be included within the scope of the present inventive concept

What is claimed is:

1. A display apparatus comprising:

a display panel which displays an image;

a gate driver which outputs gate signals to the display panel; and a data driver which outputs data voltages to the display panel, the data driver comprising a plurality of data driving circuits, wherein at least two data driving circuits among the data driving circuits are turned on during respective first turn on periods of a vertical blank period having different first durations and turned off during respective second turn off periods of the vertical blank period having second durations.

2. The display apparatus of claim 1, wherein the data driving circuits are sequentially turned off in the vertical blank period.

3. The display apparatus of claim 2, wherein the data driving circuits are sequentially turned on in the vertical blank period.

4. The display apparatus of claim 3, wherein the second durations are substantially the same.

5. The display apparatus of claim 1, wherein at least one data driving circuit among the data driving circuits comprises:

a digital to analog converter which receives data signals having a digital type and converts the data signals into the data voltages having an analog type;

a plurality of output buffers which output the data voltages to the data lines; and a plurality of output buffer switches disposed between the data lines and the output buffers, and enable or disable connections between the data lines and the output buffers.

6. The display apparatus of claim 5, further comprising a driving controller that controls an operation of the gate driver and an operation of the data driver, wherein the data driving circuits comprise a first data driving circuit and a second data driving circuit, and wherein the driving controller outputs a first switching signal for controlling an operation of output buffer switches of the first data driving circuit to the first data driving circuit and a second switching signal for controlling an operation of output buffer switches of the second data driving circuit to the second data driving circuit.

7. The display apparatus of claim 5, further comprising a driving controller that controls an operation of the gate driver and an operation of the data driver, wherein the data driving circuits comprise a first data driving circuit and a second data driving circuit, wherein the driving controller outputs a first switching signal for controlling an operation of output buffer switches of the first data driving circuit to the first data driving circuit, and wherein the first data driving circuit outputs a second switching signal for controlling an operation of output buffer switches of the second data driving circuit to the second data driving circuit.

8. The display apparatus of claim 7, wherein the first data driving circuit comprises a switching controller which receives the first switching signal, controls the output buffer switches of the first data driving circuit, generates the second switching signal based on the first switching signal and outputs the second switching signal to the second data driving circuit.

9. The display apparatus of claim 1, wherein the data driving circuits are data integrated circuit chips.

10. The display apparatus of claim 1, wherein at least one data driving circuit among the data driving circuits has a first turn on period among the first turn on periods, a second turn on period and a turn off period between the first turn on period and the second turn on period in the vertical blank period.

11. The display apparatus of claim 10, wherein at least one data driving circuit among the data driving circuits outputs last data voltages of a first active period which is prior to the vertical blank period during the first turn on period.

12. The display apparatus of claim 11, wherein at least one data driving circuit among the data driving circuits outputs first data voltages of a second active period which is after the vertical blank period during the second turn on period.

13. The display apparatus of claim 10, wherein at least one data driving circuit among the data driving circuits outputs a first data voltage representing a first preset grayscale during the first turn on period and the first data voltage representing the first preset grayscale during the second turn on period.

14. A method of driving a display panel, the method comprising:

outputting gate signals to the display panel; and outputting data voltages to the display panel using a plurality of data driving circuits, wherein at least two data driving circuits among the data driving circuits are turned on during respective first turn on periods of a vertical blank period having different first durations and turned off during respective second turn off period of the vertical blank period having second durations.

15. The method of claim 14, wherein the data driving circuits are sequentially turned off in the vertical blank period.

16. The method of claim 15, wherein the data driving circuits are sequentially turned on in the vertical blank period.

17. The method of claim 16, wherein the second durations are substantially the same.

18. The method of claim 14, wherein at least one data driving circuit among the data driving circuits has a first turn on period among the first turn on periods, a second turn on period and a turn off period between the first turn on period and the second turn on period in the vertical blank period.

19. The method of claim 18, wherein at least one data driving circuit among the data driving circuits outputs last data voltages of a first active period which is prior to the vertical blank period during the first turn on period.

20. The method of claim 19, wherein at least one data driving circuit among the data driving circuits outputs first data voltages of a second active period which is after the vertical blank period during the second turn on period.

21. A display panel driver for driving a display panel comprising a display area including first and second display blocks and a dummy area, the display panel driver comprising:

a first data driving circuit driving the first display block;

a second data driving circuit driving the second display block; and a driving controller controlling the data driving circuits to output data voltages to the display blocks during an active period of a frame period, the first data driving circuit to output dummy data voltages to the dummy area during a first turn on period of a vertical blanking period of the frame period, the second data driving circuit to output dummy data voltages to the dummy area during a second turn on period of the vertical blanking period of the frame period, wherein durations of the first and second turn on periods differ from one another.

22. The display panel driver of claim 21, wherein the driving controller prevents the first data driving circuit from outputting a data voltage or a dummy data voltage during a first turn off period of the vertical blank period that starts after the first turn on period, and prevents the second data driving circuit from outputting a data voltage or a dummy data voltage during a second turn off period of the vertical blank period that starts after the second turn on period.

23. The display panel driver of claim 22, wherein the driving controller controls the first data driving circuit to output dummy data voltages to the dummy area during a third turn on period of the vertical blanking period after the first turn off period, the second data driving circuit to output dummy data voltages to the dummy area during a fourth turn on period of the vertical blanking period after the second turn off period.

24. The display panel driver of claim 22, wherein a duration of the first turn off period is the same as a duration of the second turn off period.

25. The display panel driver of claim 21, wherein the first turn on period and second turn on period begin when the active period ends, and end at different times within the vertical blank period.

* * * * *